US007121200B2

(12) United States Patent
Ho

(10) Patent No.: US 7,121,200 B2
(45) Date of Patent: Oct. 17, 2006

(54) ROLLER PARALLELISM ADJUSTMENT STRUCTURE

(76) Inventor: Chi-Min Ho, No. 4-32, Alley 80, Kuan Yin Hsiang, Pai Sha Village, Hua Tan Hsiang, Chang Hua Hsien (TW)

( * ) Notice: Subject to any disclaimer, the term of this patent is extended or adjusted under 35 U.S.C. 154(b) by 33 days.

(21) Appl. No.: 10/994,675

(22) Filed: Nov. 22, 2004

(65) Prior Publication Data

US 2006/0107861 A1 May 25, 2006

(51) Int. Cl.
*B41F 13/54* (2006.01)
*B41F 3/00* (2006.01)
*B41F 3/02* (2006.01)

(52) U.S. Cl. ..... 101/228; 271/226; 271/228

(58) Field of Classification Search ..... 271/226, 271/228; 101/409, 228
See application file for complete search history.

(56) References Cited

U.S. PATENT DOCUMENTS 3,167,010 A * 1/1965 Worthington et al. .. 101/352.08
3,433,155 A * 3/1969 Norton ..... 101/148
4,475,457 A * 10/1984 Davison ..... 101/228
4,480,827 A * 11/1984 Shultz et al. ..... 271/111
4,831,461 A * 5/1989 Ohta et al. ..... 358/296
5,284,092 A * 2/1994 Simeth ..... 101/378
6,546,863 B1 * 4/2003 Schaum et al. ..... 101/248

OTHER PUBLICATIONS

Taiwan Publication No. TW529540, Apr. 21, 2003, 10 pages.

* cited by examiner

*Primary Examiner*—Andrew H. Hirshfeld
*Assistant Examiner*—Matthew Marini
(74) *Attorney, Agent, or Firm*—Alan D. Kamrath; Nikolai & Mersereau, P.A.

(57) ABSTRACT

A roller parallelism adjustment structure is provided for, a roller feeder having, a transfer roller and an impression roller. The transfer and impression rollers are located between the first end and the second end of the roller feed for transferring a material from the first end to the second end. A roller parallelism adjustment mechanism is installed in one side of the roller feeder to support one end of the impression roller and is adjustable relative to the roller feeder to keep the impression roller in parallel to the transfer roller for accurate transfer of the fed material from the first end to the second end.

4 Claims, 15 Drawing Sheets

2-2

ROLLER PARALLELISM ADJUSTMENT STRUCTURE

BACKGROUND OF THE INVENTION

1. Field of the Invention

The present invention relates to a roller feeder and, more particularly, to a roller parallelism adjustment structure, which enables the user to adjust the transfer roller and impression roller of the roller feeder to a parallel status for accurate transfer of materials.

2. Description of the Related Art

Following fast development of technology, people require more than the old concept of "workable" when buying or using a device. To survive in market competition, manufacturers shall have to provide products with less manufacturing cost having added values.

Taiwan Patent Publication No. 529540 discloses a roller feeder entitled "Improved Structure of Roller Feeder". According to this design, the roller feeder comprises a machine base 1, a transfer roller 2, an adjustment block 3, an impression roller 4, a release mechanism 5, and a digital-control power unit 6. The transfer roller 2 is pivotally mounted in the bottom side of the machine base 1. The impression roller 4 is pivotally mounted in the adjustment block 3 and rotatable by the transfer roller 2. The adjustment block 3 has an eccentric shaft 31 pivotally mounted between the two sidewalls 11 of the machine base 1. A hand wheel 32 is fastened to one end of the eccentric shaft 31. The user can rotate the hand wheel 32 to adjust the position of the adjustment block 3, so as to further adjust the pitch between the impression roller 4 and the transfer roller 2 subject to the thickness of the material E. During operation of the roller feeder, the digital-control power unit 6 is controlled to drive a transmission belt 63 to rotate the transfer roller 2 and the impression roller 4, so as to transfer the fed material. The transfer roller 2 and the impression roller 4 must be kept in parallel so that fed material can be accurately transferred to the processing machine for further processing. However, due to installation error or processing error (processing precision problem) of the transfer roller and the impression roller, the transfer roller and the impression roller may not be maintained in parallel perfectly, thereby resulting in a material transferring problem.

SUMMARY OF THE INVENTION

The present invention has been accomplished under the circumstances in view. It is the main object of the present invention to provide a roller parallelism adjustment structure, which enables the user to adjust the transfer roller and impression roller of the roller feeder to perfect parallelism if the transfer roller and the impression roller are not kept in parallel after installation due to installation error or processing error (processing precision problem) of the transfer roller and the impression roller. To achieve this and other objects of the present invention, the roller parallelism adjustment structure comprises a roller feeder and a roller parallelism adjustment mechanism. The roller feeder has a first end, a second end, and two rollers, namely, the transfer roller and the impression roller pivotally provided between the first end and the second end for transferring a material from the first end to the second end. The roller parallelism adjustment mechanism is installed in one side of the roller feeder to support one end of the impression roller and adjustable relative to the roller feeder to keep the impression roller in parallel to the transfer roller for accurate transfer of the fed material from the first end to the second end. In an alternate form of the present invention, the roller parallelism adjustment mechanism is installed in one side of the roller feeder to support one end of the transfer roller and adjustable relative to the roller feeder to keep the transfer roller in parallel to the impression roller.

DETAILED DESCRIPTION OF THE INVENTION

Figure 1:
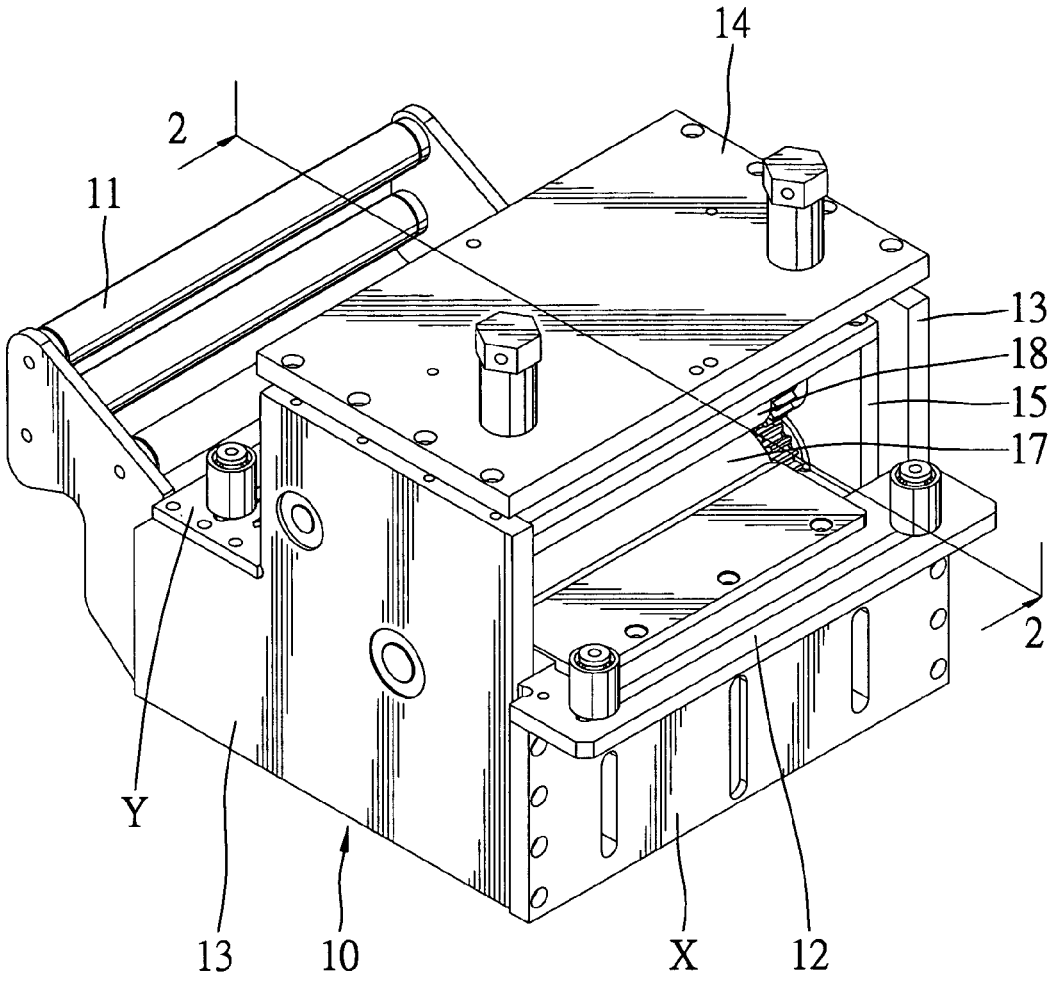
FIG. 1 is a perspective assembly view of a roller feeder according to a first embodiment of the present invention.
Figure 2:
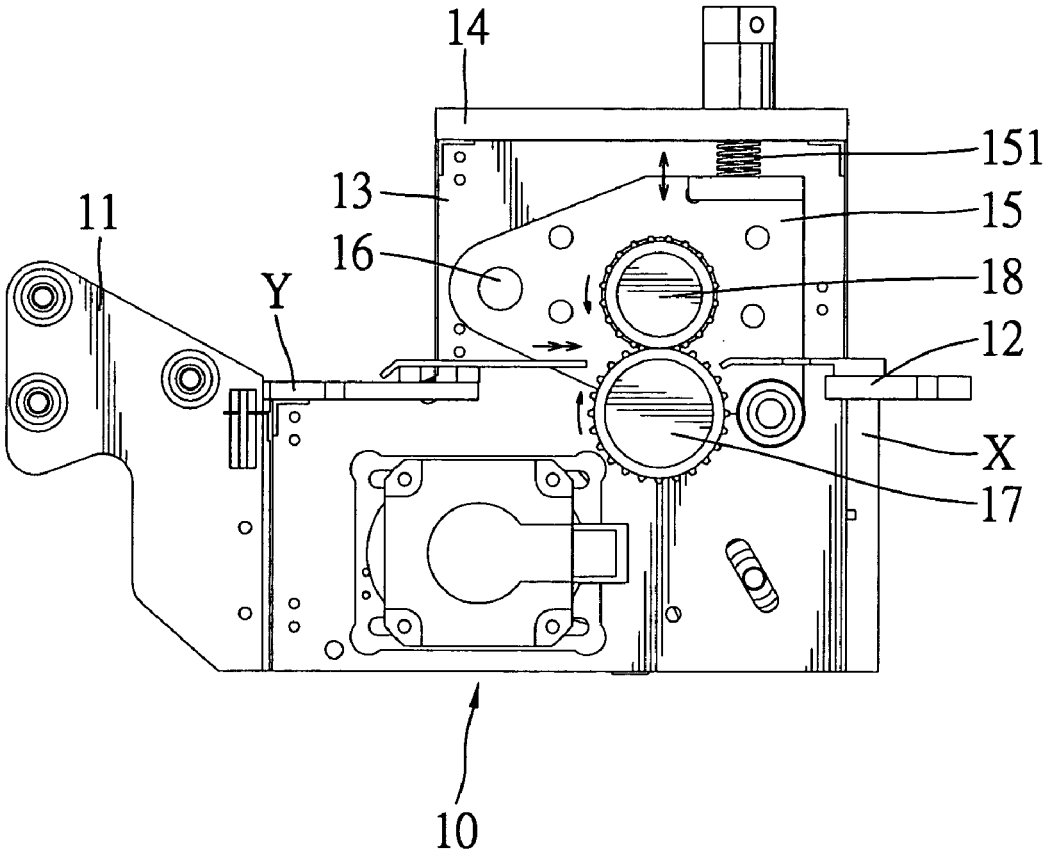
FIG. 2 is a sectional view taken along line 2—2 of FIG. 1, showing the movable side plates moved and the pitch between the transfer roller and the impression roller adjusted upon feeding of material in between the transfer roller and the impression roller.

Referring to FIGS. 1 and 2, a roller parallelism adjustment structure in accordance with the present invention is shown comprised of a roller feeder 10 and a roller parallelism adjustment mechanism 20.

The roller feeder 10 comprises a machine base formed of two side panels 13, a top panel 14, a front panel X and a rear panel Y, with the rear and front panels Y and X defining a first end 11 and a second end 12, respectively. The first end 11 is for in-feed of materials. The second end 12 is for out-feed of materials. Two movable side plates 15 are, respectively, pivotally mounted on the side panels 13 by a pivot shaft 16 for oscillation relative to the side panels 13. A transfer roller 17 and an impression roller 18 are provided between the movable side plates 15. The transfer roller 17 is driven by an external rotary driving force to rotate the impression roller 18 in the reversed direction so as to transfer fed materials from the first end 11 toward the second end 12 (see the double-arrowhead sign in FIG. 2). The transfer roller 17 is rotatably mounted between the side panels 13. The impression roller 18 is rotatably mounted between the movable side plates 15. Spring members 151 are, respectively, coupled between the side panels 13 and the movable side plates 15 to bias the movable side plates 15 relative to the side panels 13. When biasing the pivot shaft 16, the impression roller 18 will be forced against the transfer roller 17. When a material is fed in between the impression roller 18 and the transfer roller 17, the impression roller 18 will be slightly forced upwards by the fed material, and the movable side plates 15 will be biased to adjust the pitch between the transfer roller 17 and the impression roller 18 subject to the thickness of the fed material.

Figure 3:
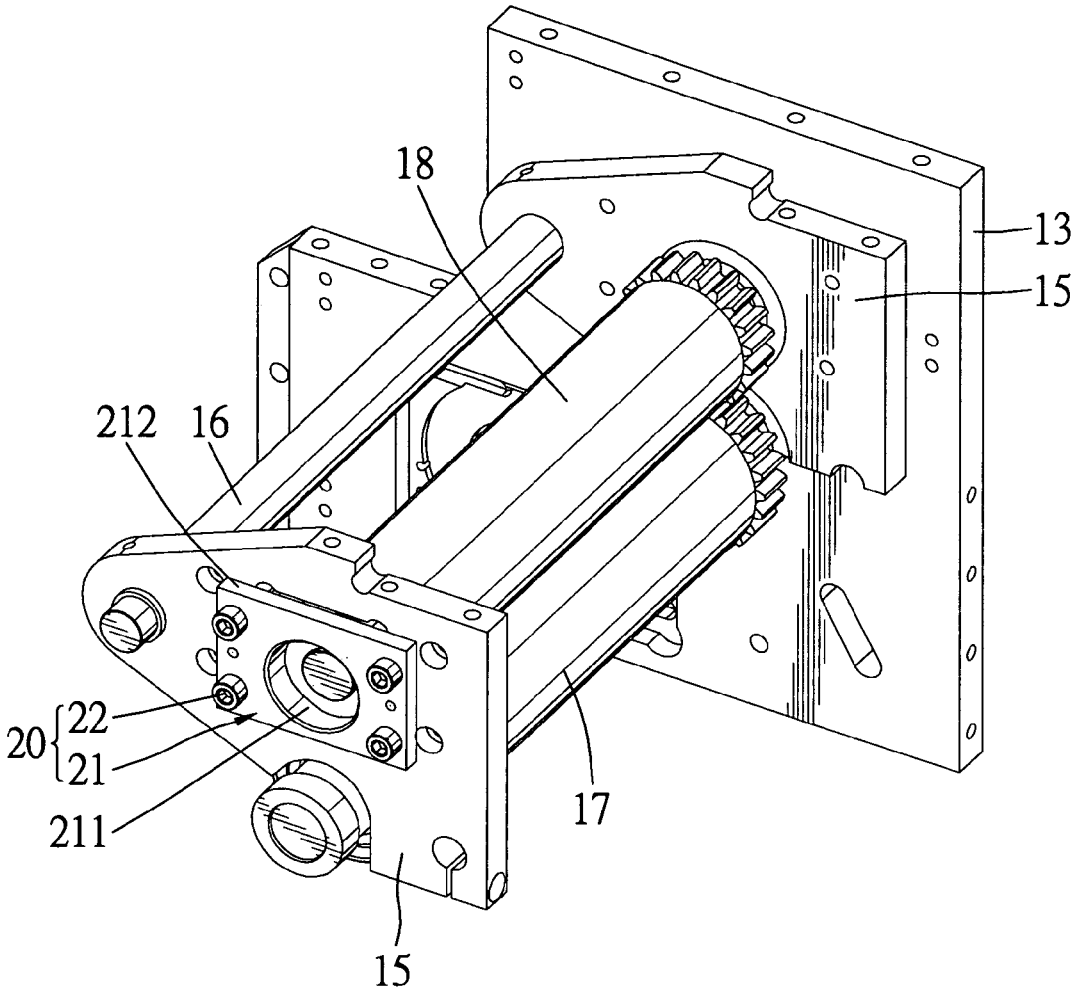
FIG. 3 is a perspective view of a part of the first embodiment of the present invention, showing the roller parallelism adjustment mechanism installed in one movable side plate according to the present invention.

Referring to FIG. 3, the roller parallelism adjustment mechanism 20 is mounted on one movable side plate 15. The impression roller 18 has one end rotatable to one movable side plate 15 that does not carry the parallelism adjustment mechanism 20, and the other end rotatable to the roller parallelism adjustment mechanism 20.

Figure 4:
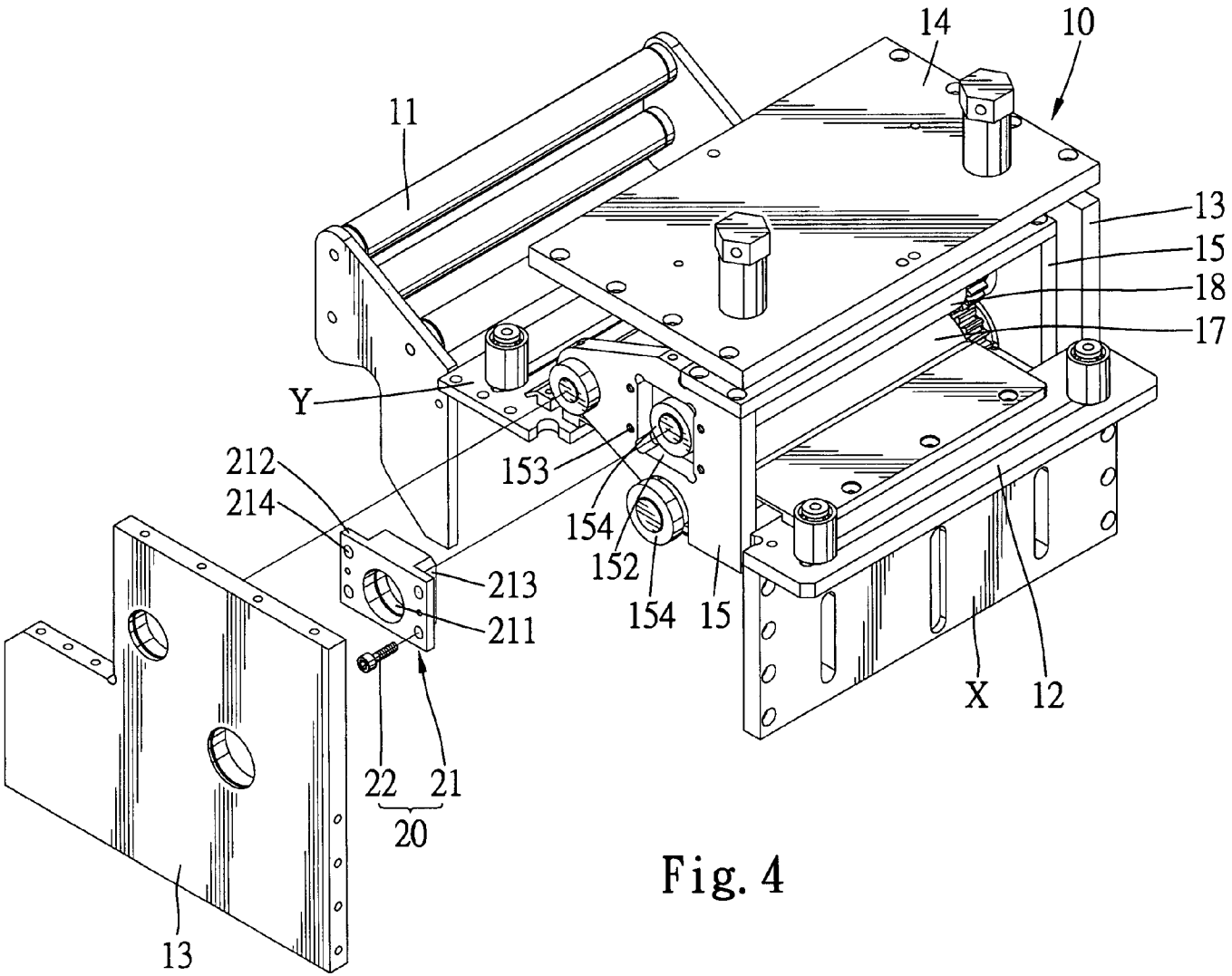
FIG. 4 is an exploded view of FIG. 1.

Referring to FIG. 4, the movable side plate 15 has a slot 152 for receiving one end of the impression roller 18 and the roller parallelism adjustment mechanism 20. A plurality of screw holes 153 are located around the slot 152. The roller parallelism adjustment mechanism 20 comprises a base block 21 and a plurality of screws 22. The base block 21 comprises a flat stop wall 212, a bearing hole 211 cut through the flat stop wall 212, an insertion flange 213 perpendicularly extended from the back side of the flat stop wall 212 around the bearing hole 211, and a plurality of adjustment through holes 214 cut through the flat stop wall 212 around the bearing hole 211 outside the insertion flange 213, The screws 22 are respectively, mounted in the adjustment through holes 214.

Figure 5:
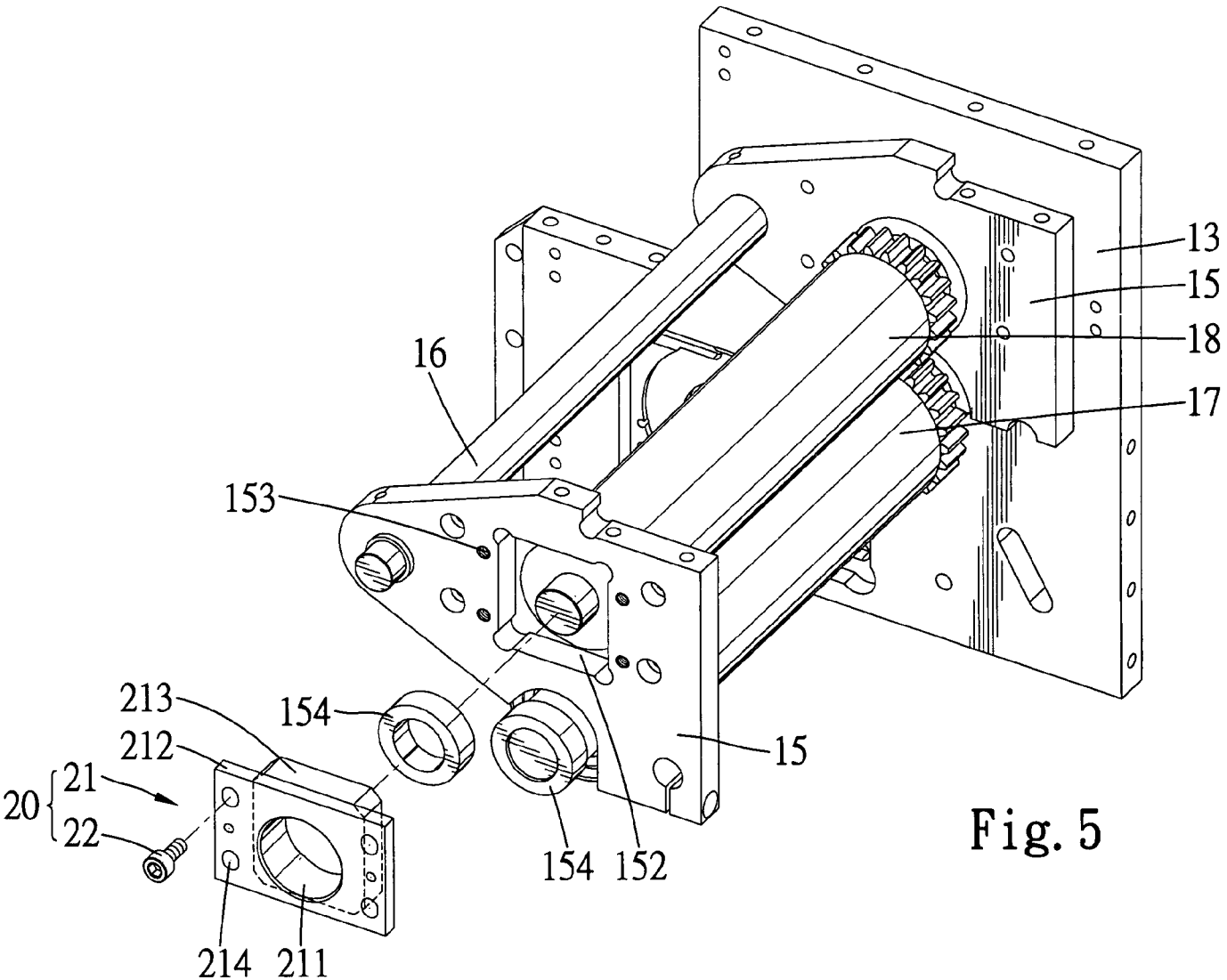
FIG. 5 is an exploded view of FIG. 3.

Referring to FIG. 5, the insertion flange 213 is inserted into the slot 152 in the movable side plate 15 with the flat stop wall 212 stopped against the movable side plate 15 outside the slot 152. After insertion of one end of the impression roller 18 into the bearing hole 211 of the base block 21, screws 22 are, respectively, inserted through the adjustment through holes 214 and threaded into the respective screw holes 153 to affix the base block 21 to the movable side plate 15. In order to smoothen rotation of the impression roller 18, a bearing 154 is mounted in the bearing hole 211 of the base block 21 to support the respective end of the impression roller 18.

Figure 6:
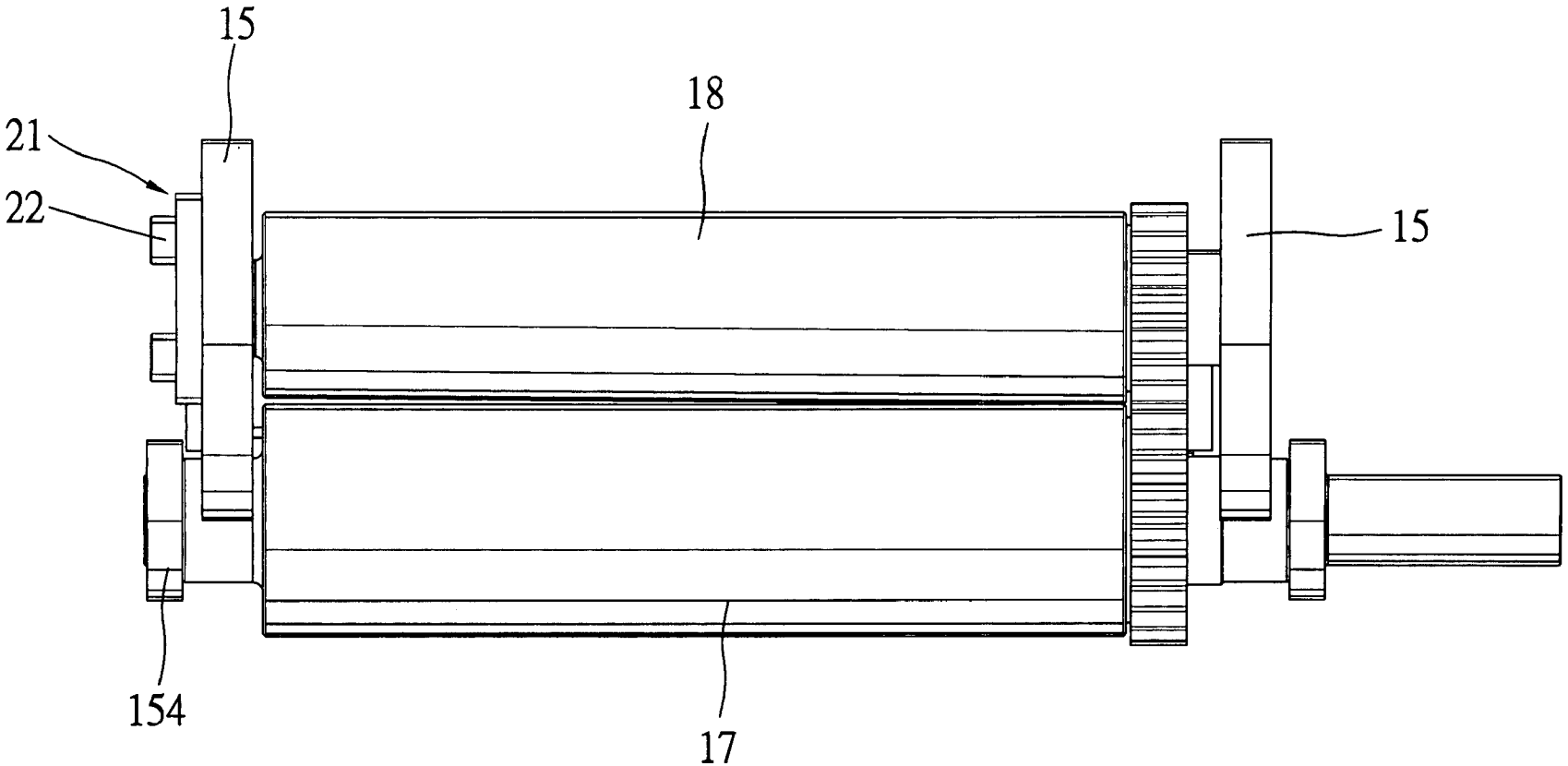
FIG. 6 is a schematic drawing showing the impression cylinder slopped downwardly in direction from the left side toward the right side relative to the transfer roller according to the present invention.
Figure 7:
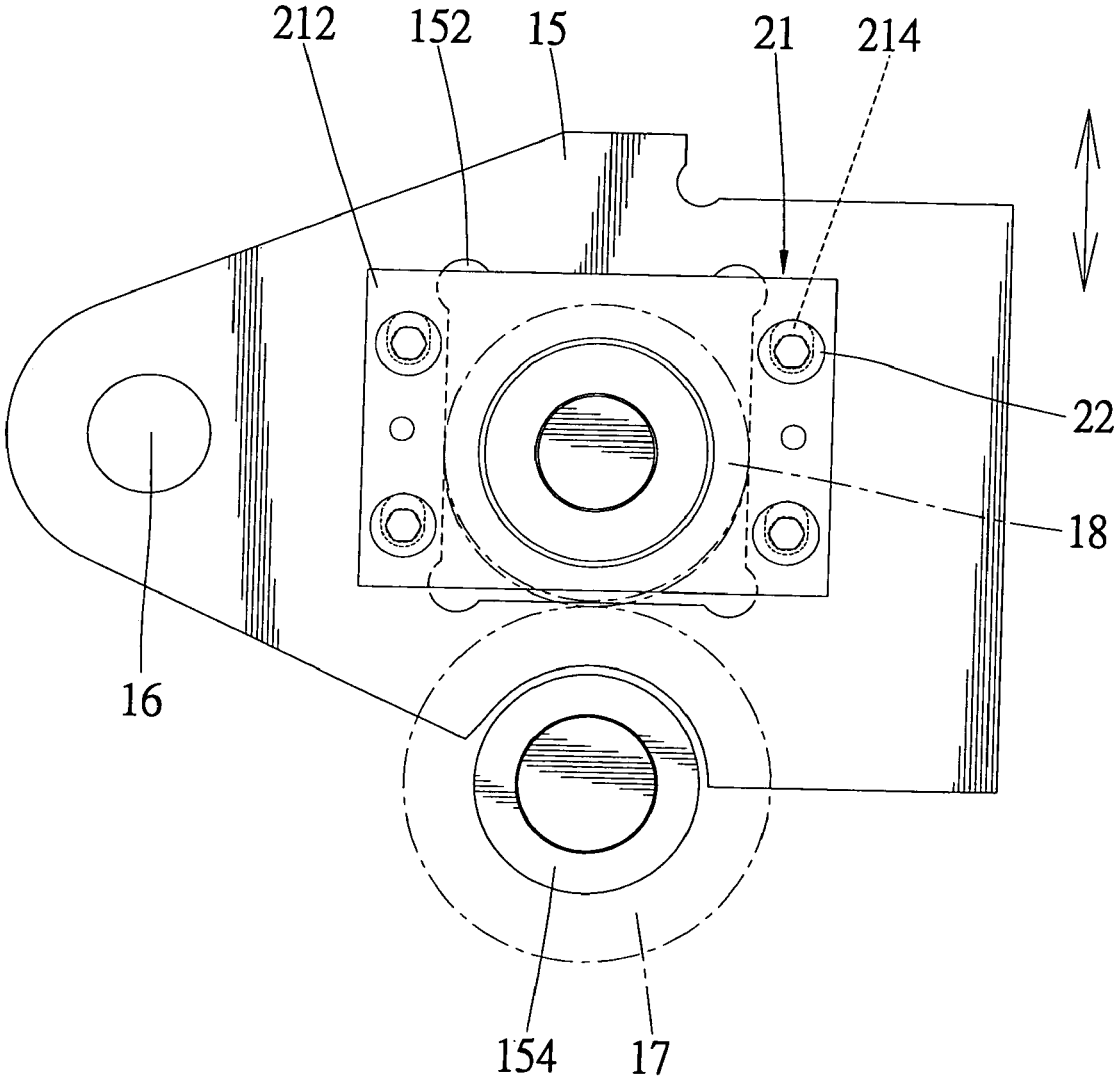
FIG. 7 is a schematic side view showing the base block of the roller parallelism adjustment mechanism deviated relative to the movable side plate and the screws deviated relative to the adjustment through holes according to the present invention.

Referring to FIG. 6, in case the impression roller 18 is tilted relative to the transfer roller 17 in one direction and sloping downwards in direction from the left side toward the right side after installation due to processing error (processing precision problem) of the transfer roller 17 and the impression roller 18, the transfer roller 17 and the impression roller 18 are not maintained in parallel at this time, and fed material will not be accurately fed to the processing machine. Referring to FIG. 7, when the transfer roller 17 and the impression roller 18 are not maintained in parallel, the base block 21 of the parallelism adjustment mechanism 20 is deviated from the movable side plate 15, and the screws 22 are, respectively, deviated from the respective center of the adjustment through holes 214.

Figure 8:
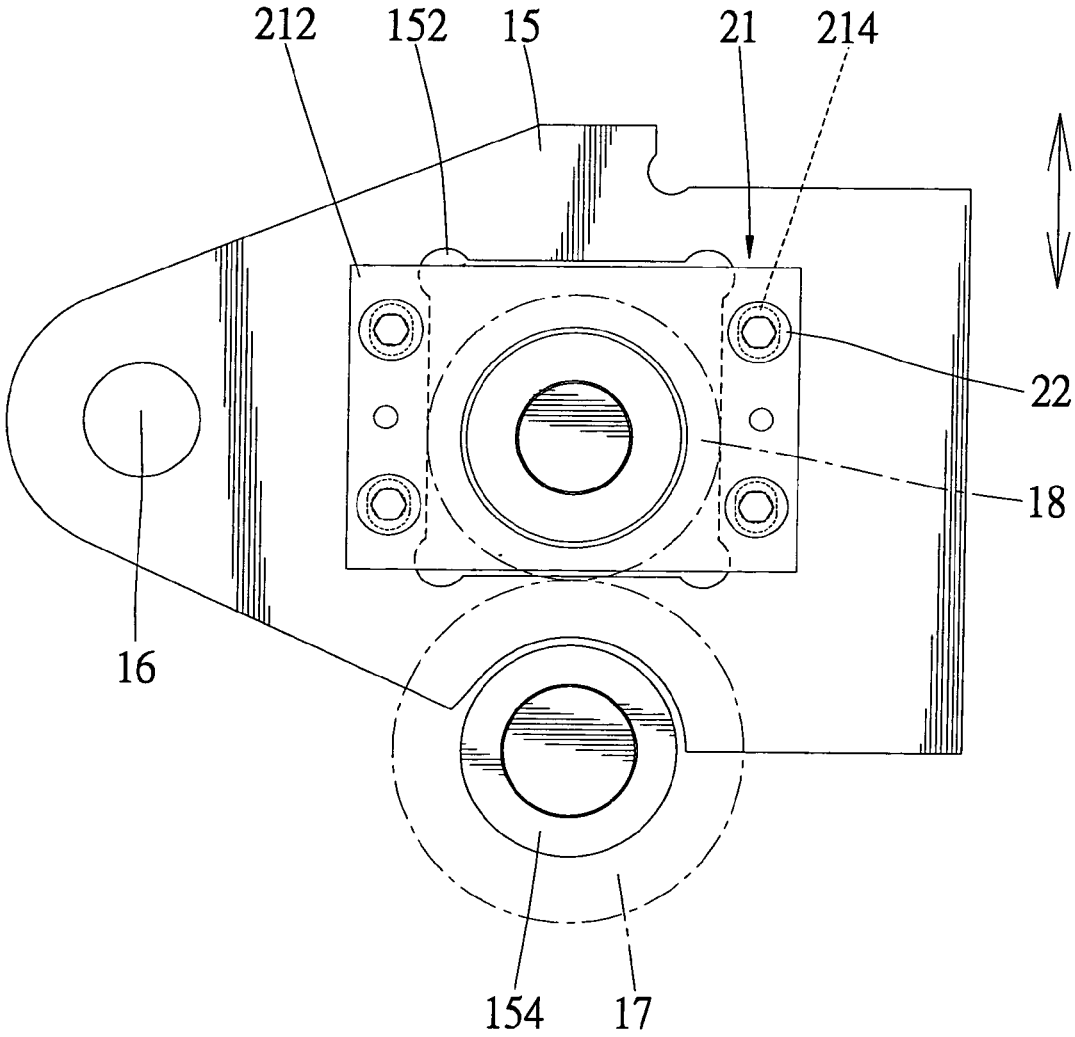
FIG. 8 is a schematic side view showing the base block of the roller parallelism adjustment mechanism adjusted and the screws in axial alignment with the respective center of the adjustment through holes according to the present invention.
Figure 9:
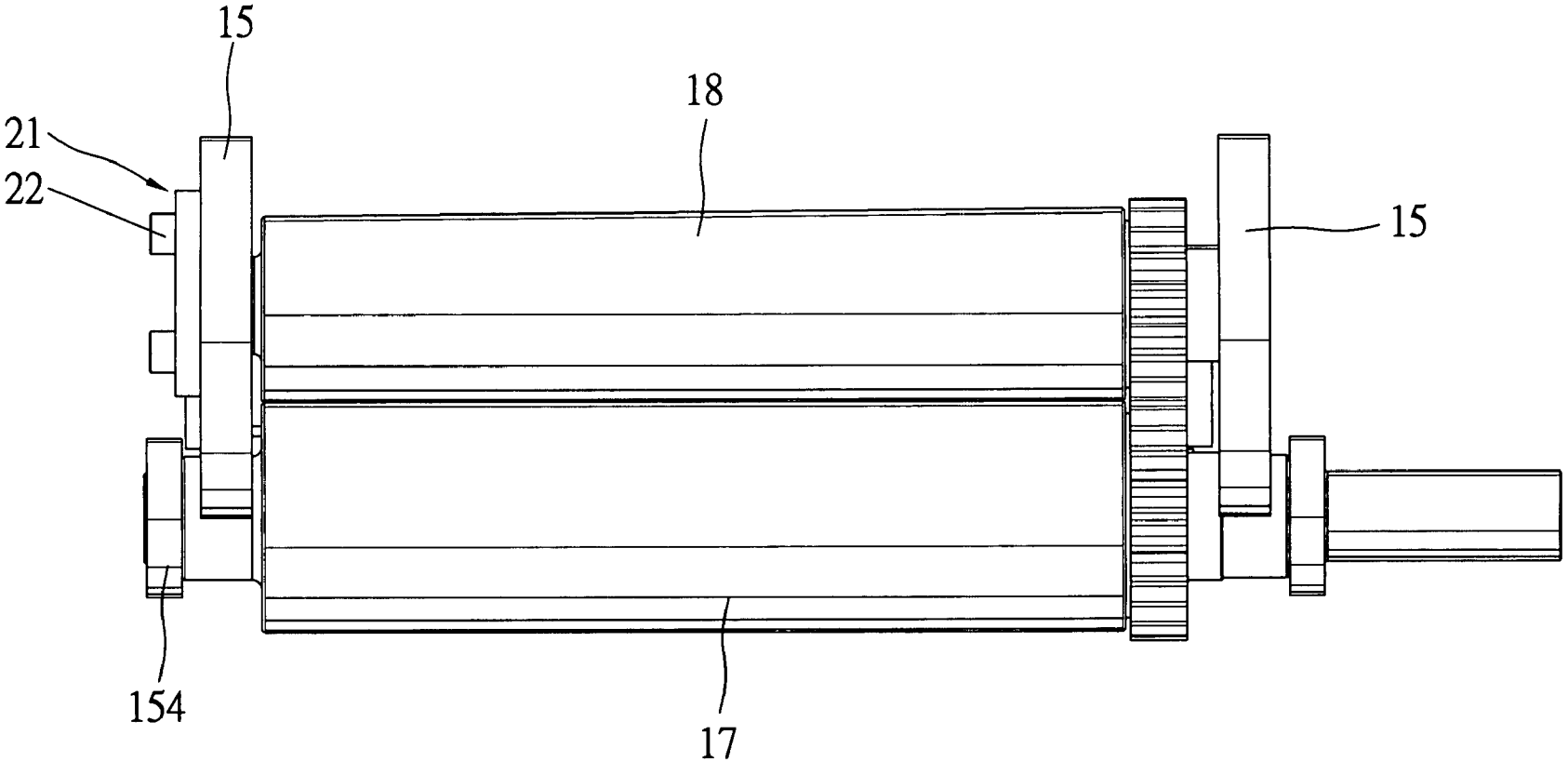
FIG. 9 is a schematic drawing showing the transfer roller and the impression roller kept in parallel after adjustment according to the present invention.

Referring to FIGS. 8 and 9, in that event, the screws 22 are loosened. Then the base block 21 is moved in the slot 152 relative to the screws 22 to have the screws 22 be in axial alignment with the respective center of the adjustment through holes 214. After axial alignment, the screws 22 are fastened tight again, keeping the impression roller 18 in parallel to the transfer roller 17.

Figure 10:
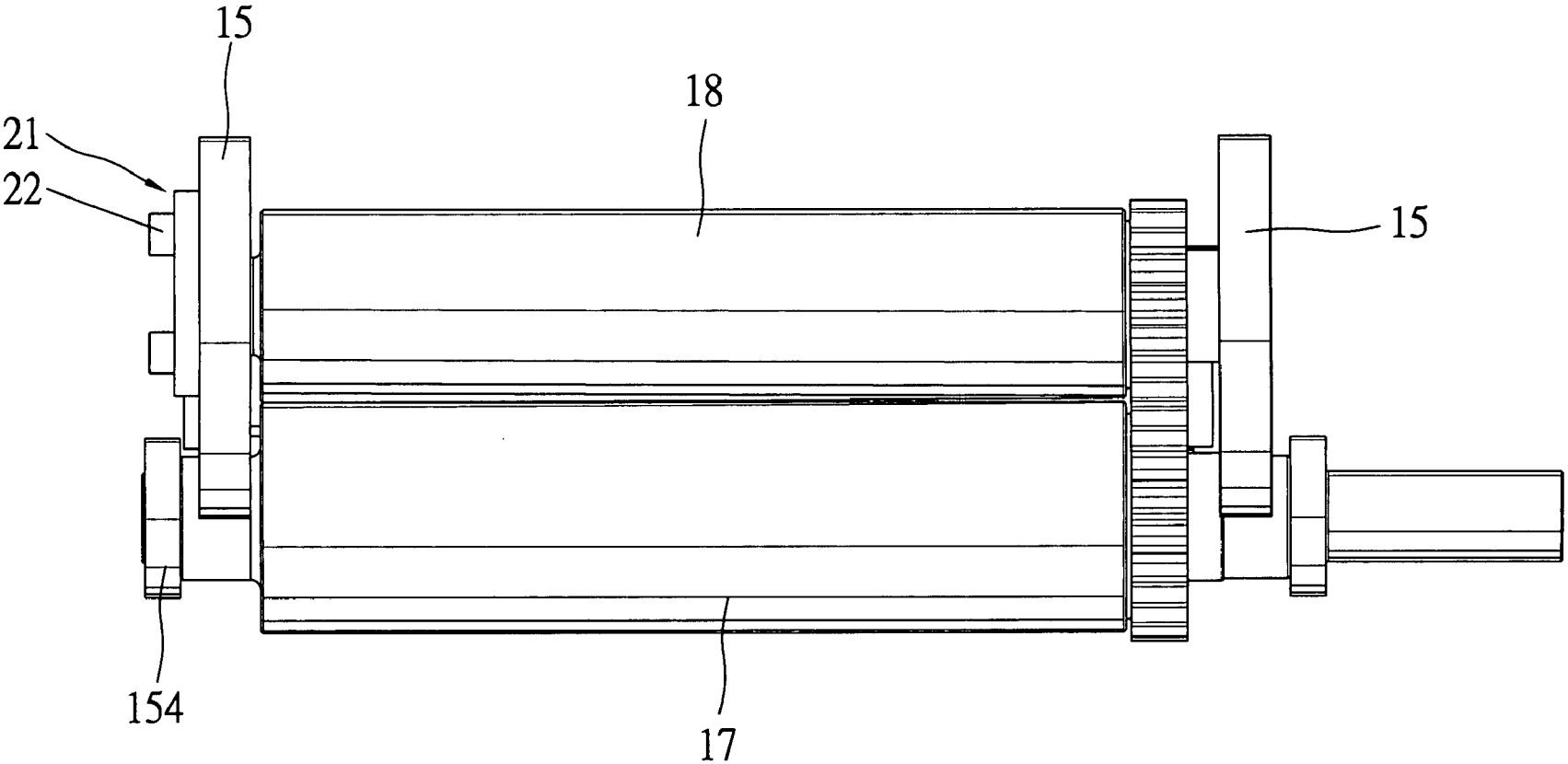
FIG. 10 is a schematic drawing showing the impression cylinder slopped downwardly in direction from the right side toward the left side relative to the transfer roller according to the present invention.
Figure 11:
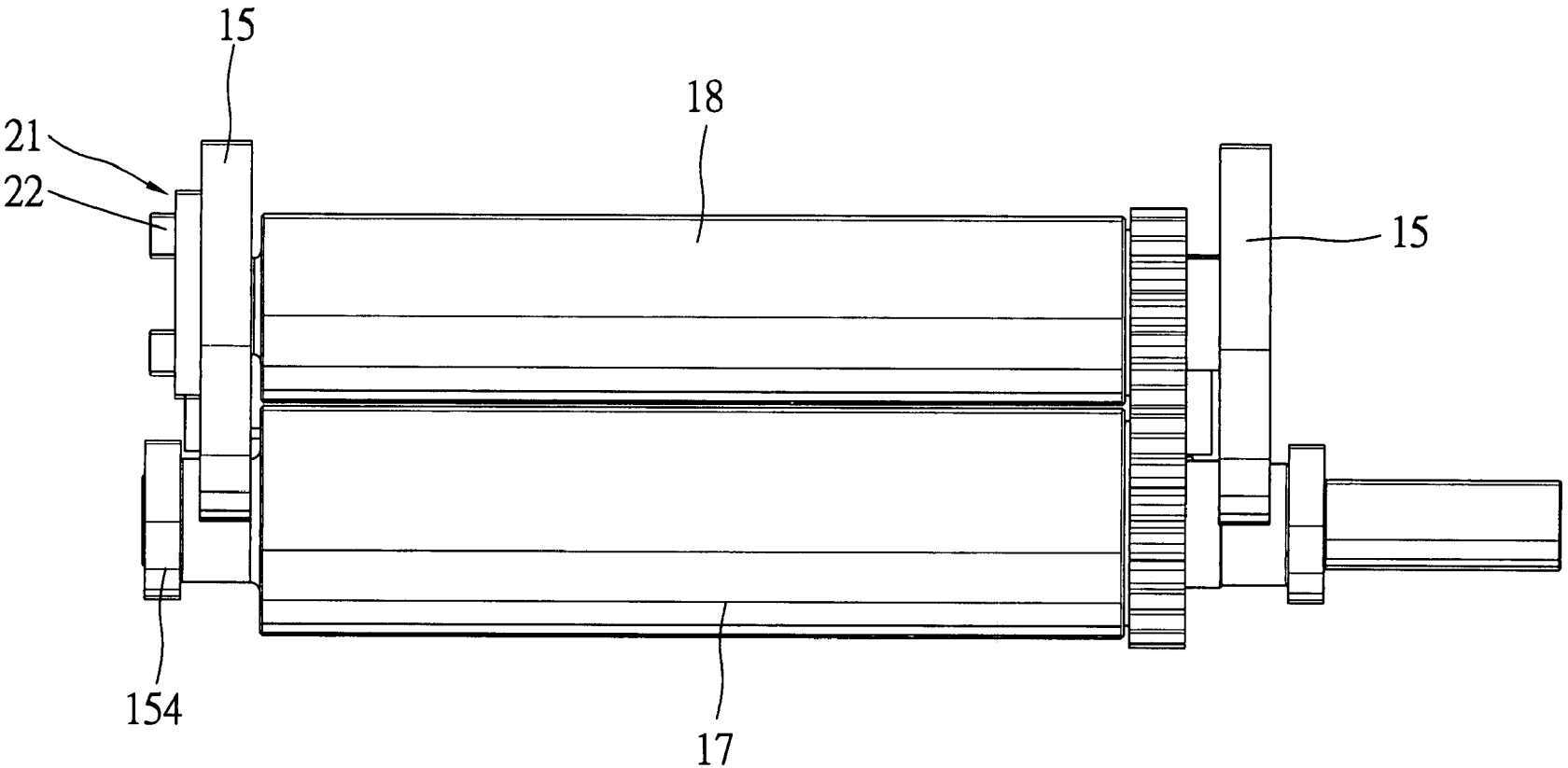
FIG. 11 is a schematic drawing showing the transfer roller and the impression roller kept in parallel after adjustment according to the present invention.

Referring to FIG. 10, the impression roller 18 may be tilted relative to the transfer roller 17 and sloping downwards in direction from the right side toward the left side, causing a material feeding problem. In that event, the screws 22 are loosened. Then, the base block 21 is moved in the slot 152 relative to the screws 22 to have the screws 22 be in axial alignment with the respective center of the adjustment through holes 214. After axial alignment, the screws 22 are fastened tight again, keeping the impression roller 18 in parallel to the transfer roller 17.

Figure 12:
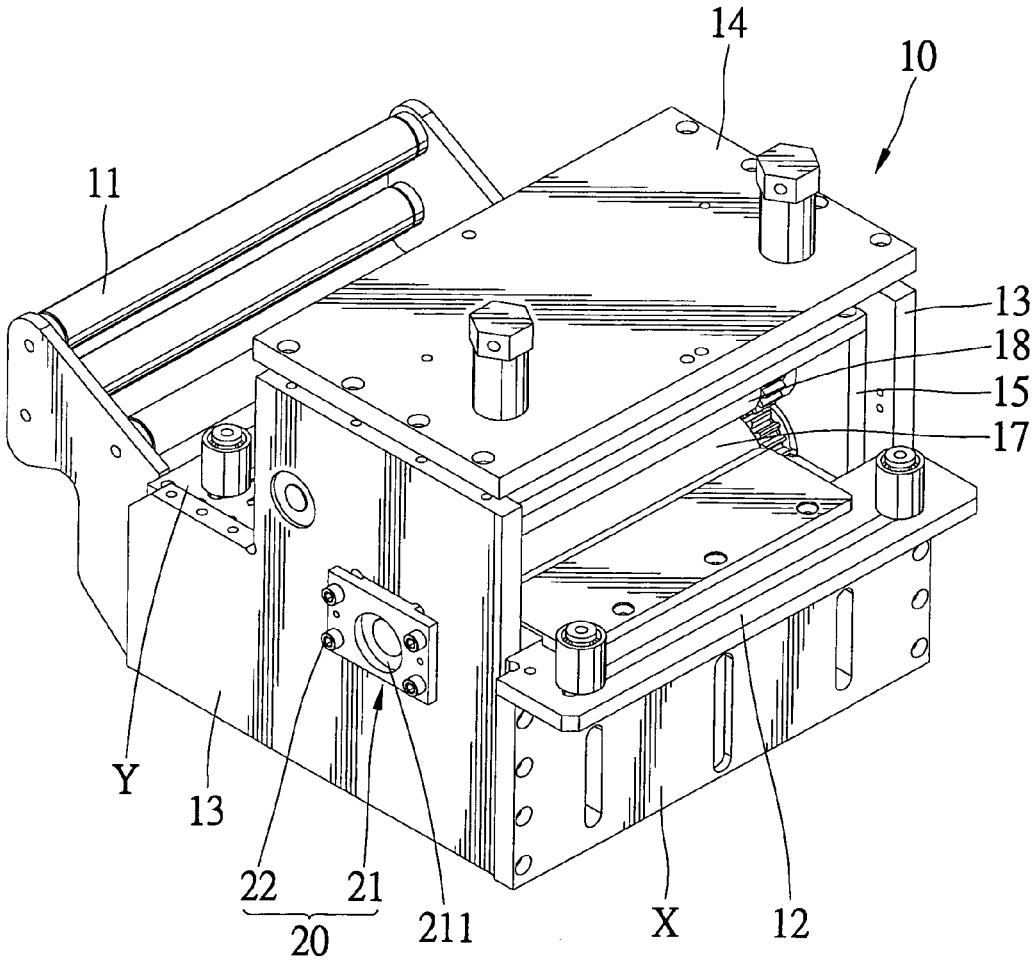
FIG. 12 is a perspective assembly view of a roller feeder according to a second embodiment of the present invention.
Figure 13:
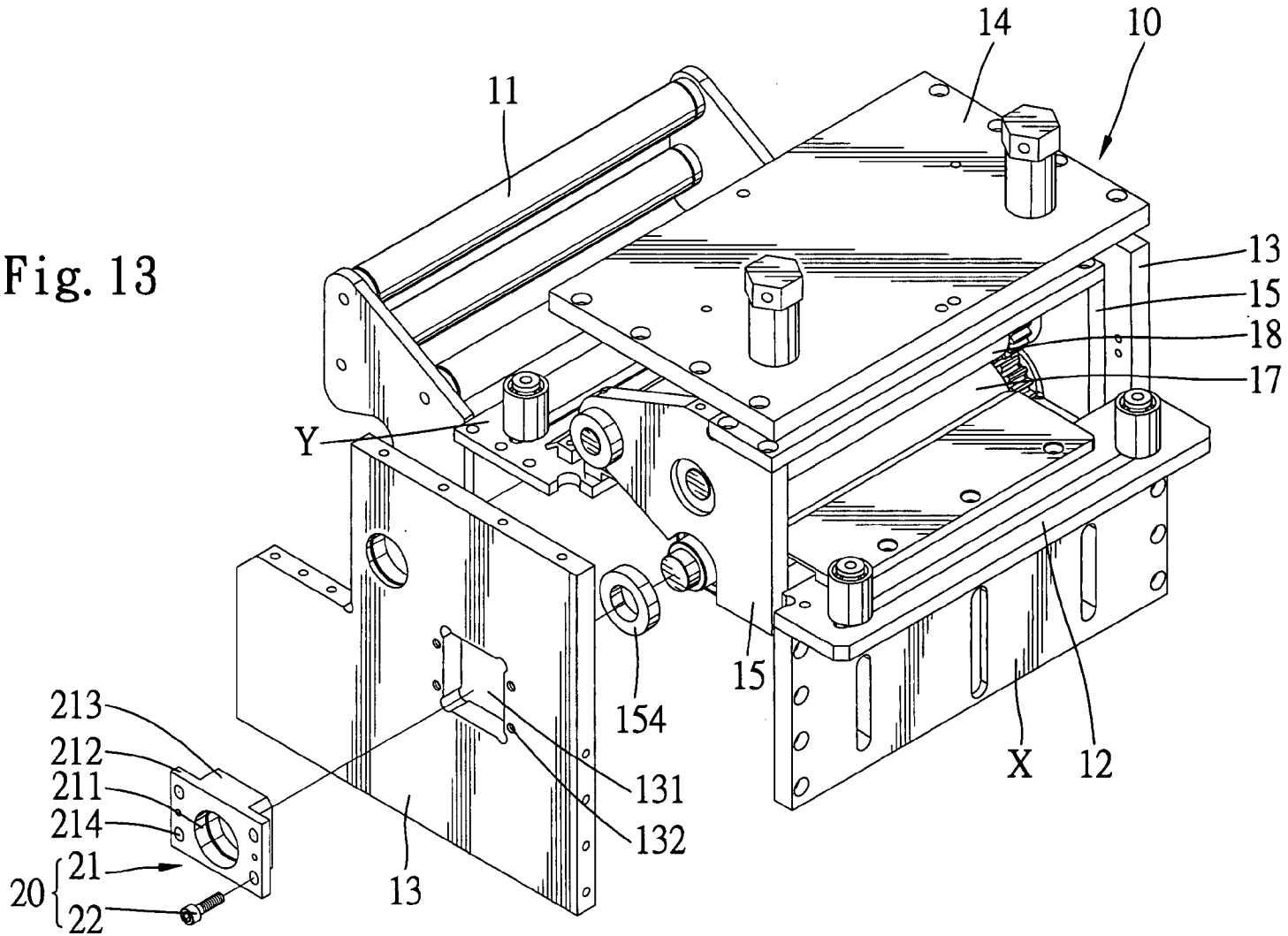
FIG. 13 is an exploded view of the second embodiment of the present invention.

FIG. 12 shows roller parallelism adjustment structure according to the second embodiment of the present invention. This embodiment is substantially similar to the aforesaid first embodiment of the present invention with the exception that the impression roller 18 is rotatably mounted between the two movable side plates 15, and the parallelism adjustment mechanism 20 supports one end of the transfer roller 17. Referring to FIG. 13, one side panel 13 of the roller feeder 10 has a slot 131 and a plurality of screw holes 132 around the slot 131. The insertion flange 213 is inserted into the slot 131, and the flat stop wall 212 is stopped against the side panel 13 outside the slot 131. After insertion of one end of the transfer roller 17 into the bearing hole 211, the screws 22 are, respectively, mounted in the adjustment through holes 214 and threaded into the respective screw holes 132 of the respective side panel 13. In order to smoothen rotation of the transfer roller 17, a bearing 154 is mounted in the bearing hole 211 of the base block 21 to support the respective end of the transfer roller 17.

Figure 14:
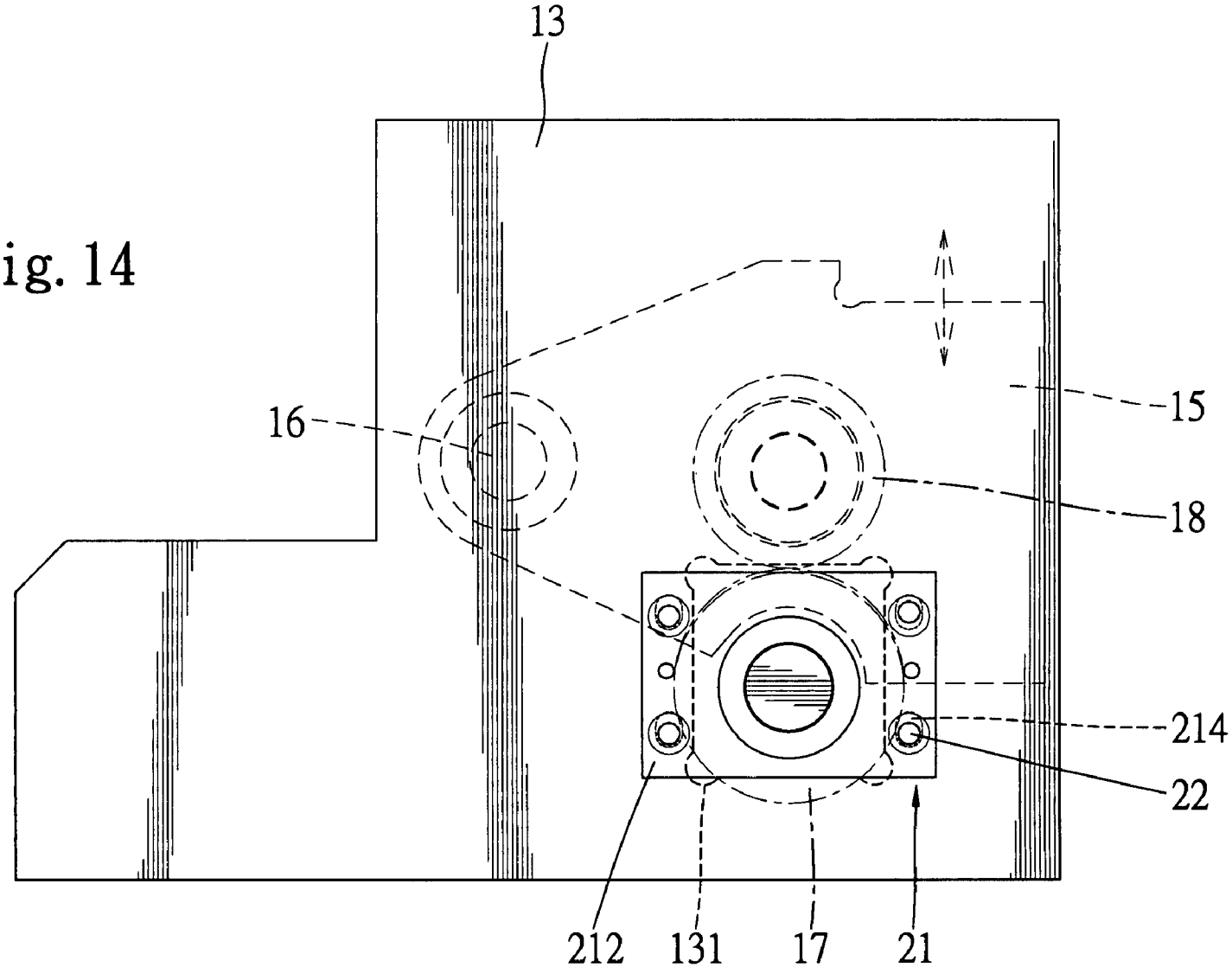
FIG. 14 is a schematic side view of the second embodiment of the present invention, showing the base block of the roller parallelism adjustment mechanism deviated relative to the side panel and the screws deviated relative to the adjustment through holes according to the present invention.
Figure 15:
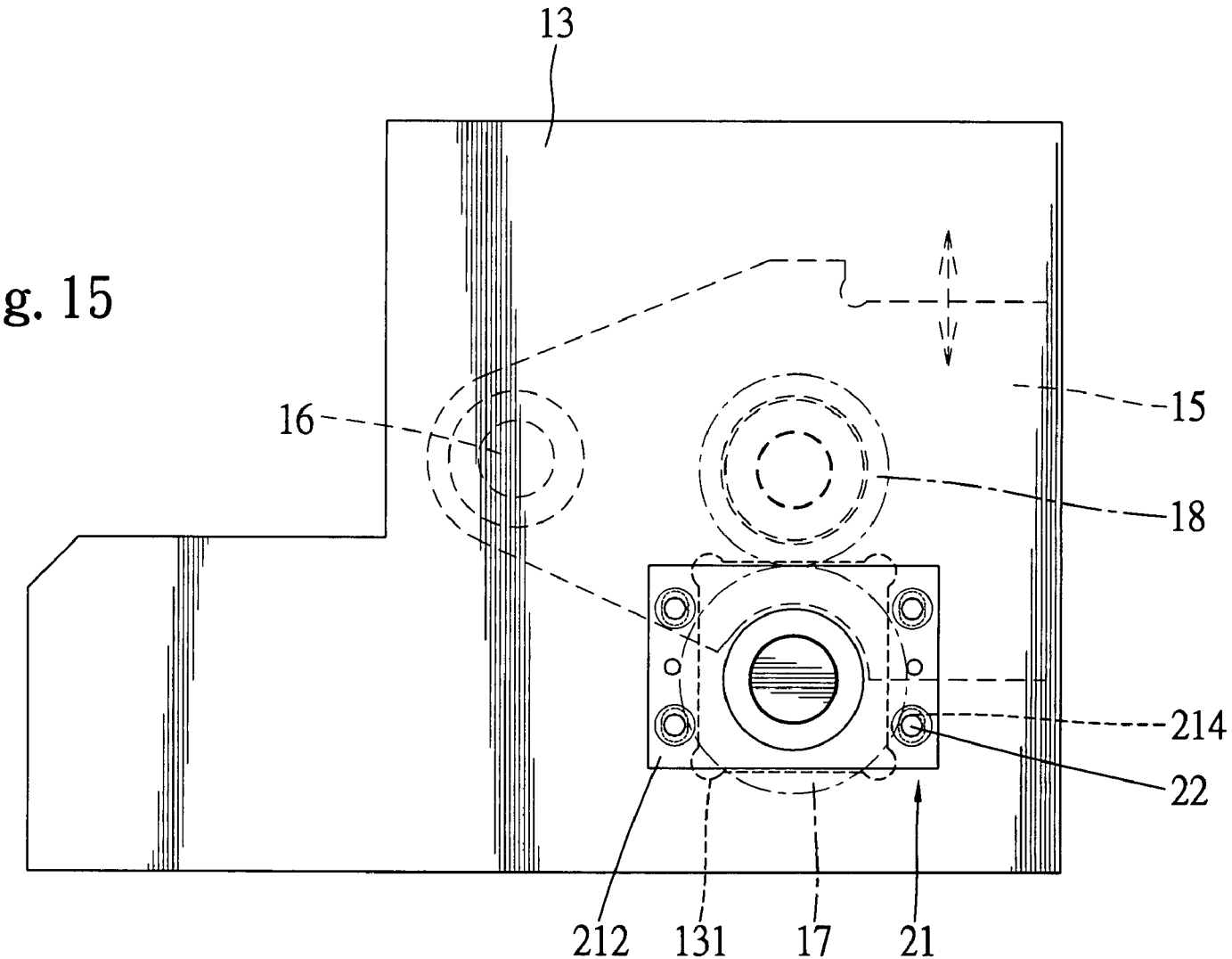
FIG. 15 is similar to FIG. 14 but showing the roller parallelism adjustment mechanism adjusted, the screws in axial alignment with the respective center of the adjustment through holes.

Referring to FIG. 14, in case the transfer roller 17 is tilted relative to the impression roller 18 in one direction after installation due to processing error (processing precision problem) of the transfer roller 17 and the impression roller 18, the transfer roller 17 and the impression roller 18 are not maintained in parallel, the base block 21 of the parallelism adjustment mechanism 20 is deviated from the respective side panel 13, and the screws 22 are, respectively, deviated from the respective center of the adjustment through holes 214. In that event, as shown in FIG. 15, the screws 22 are loosened. Then the base block 21 is moved in the slot 131 relative to the screws 22 to have the screws 22 be in axial alignment with the respective center of the adjustment through holes 214. After axial alignment, the screws 22 are fastened tight again, keeping the transfer roller 17 in parallel to the impression roller 18.

As indicated above, the invention has the following advantages:

1. By adjusting the roller parallelism adjustment mechanism 20, the nonparallel problem between the transfer roller 17 and the impression roller 18 due to processing error (processing precision problem) or installation error is eliminated. Therefore, material can accurately be fed by the roller feeder 10 to the processing machine for further processing.

2. The roller parallelism adjustment mechanism 20 can be selectively installed in the roller feeder 10 between two positions to support the impression roller 18 or the transfer roller 17 to fit different types of roller feeders 10.

3. The roller parallelism adjustment structure 20 is practical for use in any of a variety of roller feeders 10 as well as a three-in-one flattening roller feeder 10.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A roller parallelism adjustment structure comprising:

a roller feeder, said roller feeder comprising a first end a second end, two side panels fixedly provided at two opposite lateral sides between said first end and said second end, two movable side plates pivotally mounted between said side panels; a transfer roller rotatably mounted between said side panels, and an impression roller rotatably mounted between said movable side plates, wherein one of the two movable side plates has a slot, with the transfer roller and the impression roller provided between said first end and said second end and adapted to transfer a material from said first end to said second end; and a roller parallelism adjustment mechanism installed in one side of said roller feeder to support one end of said impression roller and adjustable relative to said roller feeder to hold said impression roller in parallel to said transfer roller, wherein said roller parallelism adjustment mechanism comprises a base block, wherein said base block has a stop wall, a bearing hole cut through the stop wall, a bearing for rotatably receiving said one end of said impression roller and located within the bearing hole, an insertion flange integrally extending from the stop wall as a single piece and arranged around the bearing hole, a plurality of screws adapted to affix said base block to one said moveable side plate, and a plurality of adjustment through holes extending through the stop wall around the bearing hole and outside of the insertion flange, with the insertion flange being of a size for moveable receipt in the slot, with the stop wall being of a size larger than the slot, with the plurality of adjustment through holes receiving said screws; said screws are radially movably mounted in said adjustment through holes and adapted to affix said base block to said one of the two movable side plates for enabling the insertion flange to be moved in said slot and then affixed thereto in position to hold said impression roller in parallel to said transfer roller.

2. The roller parallelism adjustment structure as claimed in claim 1, wherein said movable side plates are pivoted to said side panels in such a manner that feeding of a material between said transfer roller and said impression roller causes said impression roller to be forced upwards by the fed material to adjust the pitch between said transfer roller and said impression roller subject to a thickness of the fed material.

3. A roller parallelism adjustment structure comprising:

a roller feeder, said roller feeder comprising a first end, a second end, two side panels fixedly provided at two opposite lateral sides between said first end and said second end, two movable side plates pivotally mounted between said side panels, a transfer roller rotatably mounted between said side panels, and an impression roller rotatably mounted between said movable side plates, wherein one of said two side panels has a slot, with the transfer roller and the impression roller provided between said first end and said second end and adapted to transfer a material from said first end to said second end; and a roller parallelism adjustment mechanism installed in one side of said roller feeder to support one end of said transfer roller and adjustable relative to said roller feeder to hold said transfer roller in parallel to said impression roller, wherein said roller parallelism adjustment mechanism comprises a base block, wherein said base block has a stop wall, a bearing hole cut through the stop wall, a bearing for rotatably receiving said one end of said transfer roller and located within the bearing hole, an insertion flange integrally extending from the stop wall as a single piece and arranged around the bearing hole, a plurality of screws adapted to affix said base block to one said moveable side plate and a plurality of adjustment through holes extending through the stop wall around the bearing hole and outside of the insertion flange, with the insertion flange being of a size for moveable receipt in the slot, with the stop wall being of a size larger than the slot, with the plurality of adjustment through holes receiving said screws; said screws are radially movably mounted in said adjustment through holes and adapted to affix said base block to said one of the two side panels for enabling the insertion flange to be moved in said slot and then affixed thereto in position to hold said transfer roller in parallel to said impression roller.

4. The roller parallelism adjustment structure as claimed in claim 3, wherein said movable side plates are pivoted to said side panels in such a manner that feeding of a material between said transfer roller and said impression roller causes said impression roller to be forced upwards by the fed material to adjust the pitch between said transfer roller and said impression roller subject to a thickness of the fed material.

* * * * *